US005990402A

United States Patent [19]

Epstein

[11] Patent Number: 5,990,402

[45] Date of Patent: Nov. 23, 1999

[54] MUSICAL CYMBAL HANDLE STRAP CLIP

[75] Inventor: Frank B Epstein, Brookline, Mass.

[73] Assignee: Avedis Zildjian Company, Norwell, Mass.

[21] Appl. No.: 09/042,030

[22] Filed: Mar. 13, 1998

[51] Int. Cl.[6] ..... G10D 13/02

[52] U.S. Cl. ..... 84/422.3; 84/453; 24/115 H; 24/198

[58] Field of Search ..... 84/421, 422.3, 84/327, 453, 411 R; 24/3.12, 115 H, 115 K, 197, 198, 200, 265 A, 265 R

[56] References Cited

U.S. PATENT DOCUMENTS

| | | | |
|---|---|---|---|
| 1,605,595 | 11/1926 | Lang | 224/5 |
| 2,040,958 | 5/1936 | Schottenfels | 24/198 |
| 2,212,862 | 8/1940 | Hirsh | 24/198 |
| 2,247,867 | 7/1941 | Baumann | 224/5 |
| 2,273,136 | 2/1942 | Orech et al. | 224/5 |
| 3,104,436 | 9/1963 | Ostolaza | 24/198 |
| 3,869,763 | 3/1975 | Senk et al. | 24/198 |
| 4,038,726 | 8/1977 | Takabayashi | 24/198 |
| 4,226,161 | 10/1980 | Goetsch | 84/376 A |

FOREIGN PATENT DOCUMENTS

| | | |
|---|---|---|
| 701994 | 3/1931 | France . |
| 450772 | 8/1949 | Italy . |

OTHER PUBLICATIONS

L. A. Elkington Catalog, Manufacturers Parts and Accessories For Musical Instruments, p. 3, 1963.
Rogers Catalog, pp. 5 and 52, Dec. 1964.

*Primary Examiner*—Robert E. Nappi
*Assistant Examiner*—Wesley Scott Ashton
*Attorney, Agent, or Firm*—Fish & Richardson P.C.

[57] ABSTRACT

A musical cymbal and handstrap assembly includes a musical cymbal, a cymbal handstrap clip, and a handstrap. The handstrap has a hand portion extending through an aperture in the cymbal at a first convex side of the cymbal and a securement portion extending at the second concave side of the cymbal. The handstrap clip includes a body, a pair of free arms extending from and generally along respective opposite sides of the body, and an aperture which holds a base portion of the hand portion of the handstrap. The arms and sides of the body together define slots through which the securement portion of the handstrap extends to be releasably and adjustably secured.

24 Claims, 6 Drawing Sheets

MUSICAL CYMBAL HANDLE STRAP CLIP

BACKGROUND OF THE INVENTION

The invention relates to musical cymbals, and more particularly to a strap clip for securing a handle strap to musical cymbals.

With hand held musical cymbals, hand straps are attached to the cymbals for the user's convenience. The straps are secured by feeding the straps through an opening in the cymbal and tying the ends of the straps beneath the underside of the cymbal. The knots, however, can be difficult to tie properly and can often loosen during playing. Further, if the knot contacts the cymbal, the strap interferes with the sound of cymbal.

SUMMARY OF THE INVENTION

The present invention features a musical cymbal and handstrap assembly which includes a musical cymbal, a cymbal handstrap clip, and a handstrap. The handstrap has a hand portion extending through an aperture in the cymbal onto the first side of the cymbal and a securement portion extending onto the second side of the cymbal. The handstrap clip includes a body, a pair of free arms extending from and generally along respective opposite sides of the body, and an aperture which holds a base portion of the hand portion of the handstrap. The arms and sides of the body together define slots so that the securement portion of the handstrap extends through the slots where it is releasably and adjustably secured.

In one embodiment of the invention, the free arms of the clip each have an outer region and a set of gripping elements positioned between each side of the body and at least the outer region of each free arm.

The present invention also provides a method for securing a handstrap to a cymbal. The method includes providing a cymbal, a cymbal handstrap clip, and a handstrap. The cymbal has a central aperture and the handstrap includes a securement portion and a hand portion with a base portion. The cymbal handstrap clip has a body with a body aperture and a pair of free arms extending from ends of the body and generally along sides of the body. The respective free arms and sides of the body together define respective slots. The handstrap is inserted through the central aperture of the cymbal to form a hand (loop) portion of the handstrap. The free ends and base portion of the handstrap are positioned through the body aperture of the cymbal handstrap clip. The free ends and securement portion of the handstrap are then positioned through the slots of the cymbal handstrap clip where the handstrap is releasably and adjustably secured.

The present invention also features a handstrap assembly for use with a musical cymbal. The handstrap assembly includes a cymbal handstrap clip and a handstrap having a hand portion which extends through an aperture in the cymbal onto a first side of the cymbal. The handstrap is releasably and adjustably secured to the cymbal handstrap clip by a securement portion of the handstrap which extends onto an opposite side of the cymbal from the hand portion. The cymbal handstrap clip has a body and a pair of free arms extending from opposite ends of the body and generally along respective sides of the body. An aperture in the body holds a base portion of the hand portion of the handstrap. The free arms and the sides of the body define slots through which the securement portion of the handstrap extends.

The present invention also features a musical cymbal handstrap clip for releasably and adjustably attaching a handstrap to a musical cymbal. The handstrap clip has a body and a pair of free arms extending from ends of the body generally along opposite sides. Slots are defined by the free arms and the sides of the body to also receive portions of the handstrap. The handstrap portions can be adjustably and releasably secured through the slots and through an aperture in the body.

The clip and assembly eliminates the need to use straps which have tie ends. Further, the present invention eliminates the need to tie knots in order to secure the straps. Sound interference from a knot contacting a cymbal is also avoided.

Other features and advantages of the invention will be apparent from the following description of a presently preferred embodiment, and from the claims.

DESCRIPTION OF THE PREFERRED EMBODIMENTS

Figure 1:
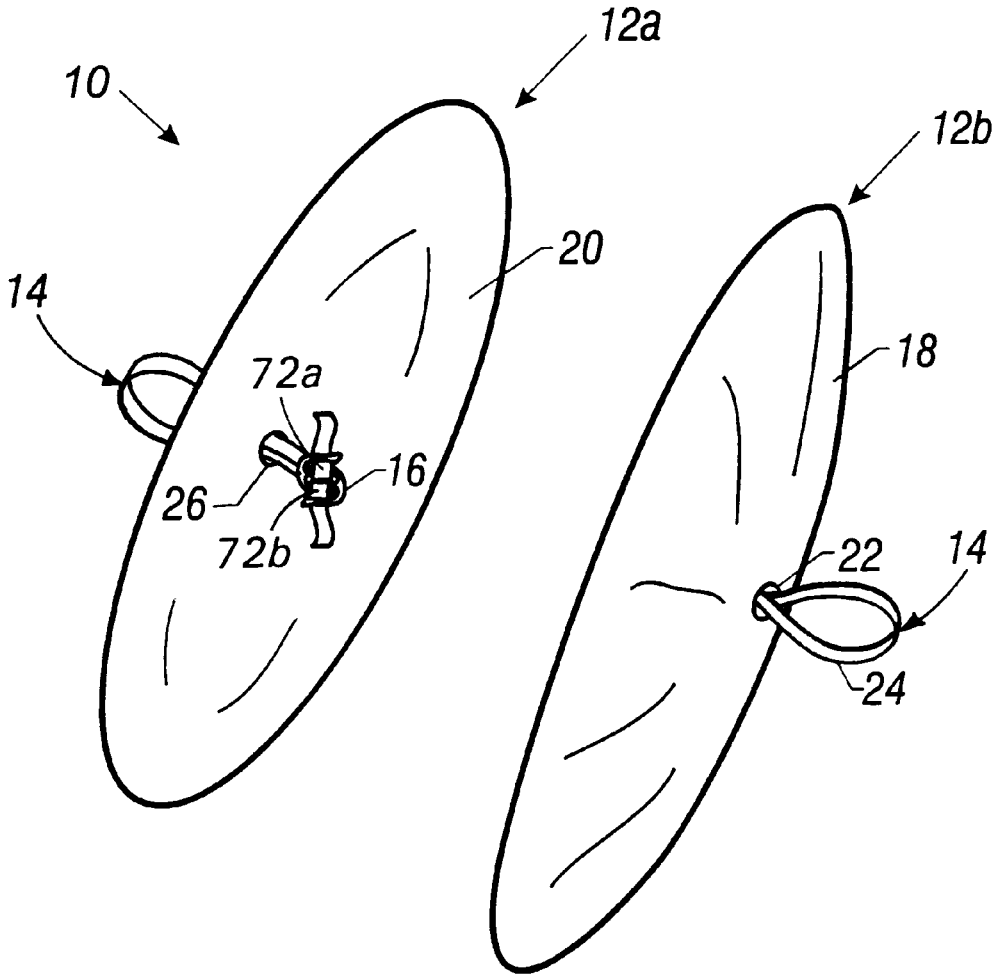
FIG. 1 is a perspective view of musical cymbals held by handstraps with clips of the invention.

Referring to FIG. 1, there is shown a musical cymbal and handstrap assembly 10 of the present invention. The assembly includes a pair of musical cymbals 12*a*, 12*b*, a cymbal handstrap clip 16 for each cymbal 12, and a handstrap 14 adjustably and releasably secured to each cymbal by the respective clip 16. Each of the musical cymbals 12*a* and 12*b* has a respective convex shaped first side 18, concave shaped second side 20, and a central aperture 22. The cymbals are similar to musical cymbals known in the art.

A handstrap 14 is placed through the central aperture 22 of each cymbal 12 and secured by clip 16. The strap 14, formed from suitable materials known in the art, such as leather, has a hand (loop) portion 24 and securement portions 72*a* and 72*b*. The strap 14 is positioned within the central aperture 22 so that the loop-like hand portion 24 of the strap 14 extends onto the convex side 18 of the cymbal 12. During playing, the user inserts his hand or wrist through the loop of the hand portion 24 to hold the cymbals. The securement portion 26 of the strap 14 extends through the clip 16 on the concave side 20 of the cymbal 12, thereby securing the strap 14 to the cymbal 12.

Figure 2:
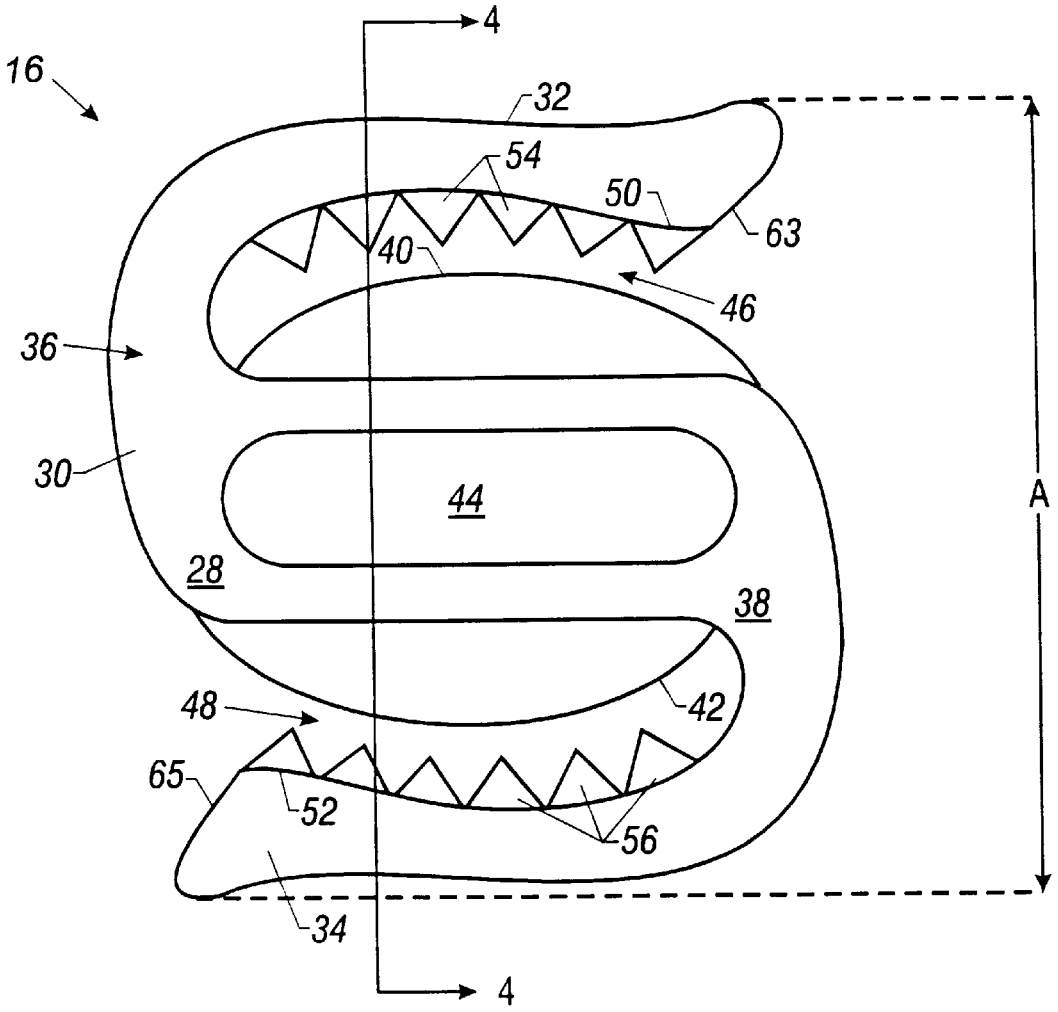
FIG. 2 is a top plan view of the cymbal handstrap clip of the invention in a closed position.
Figure 3:
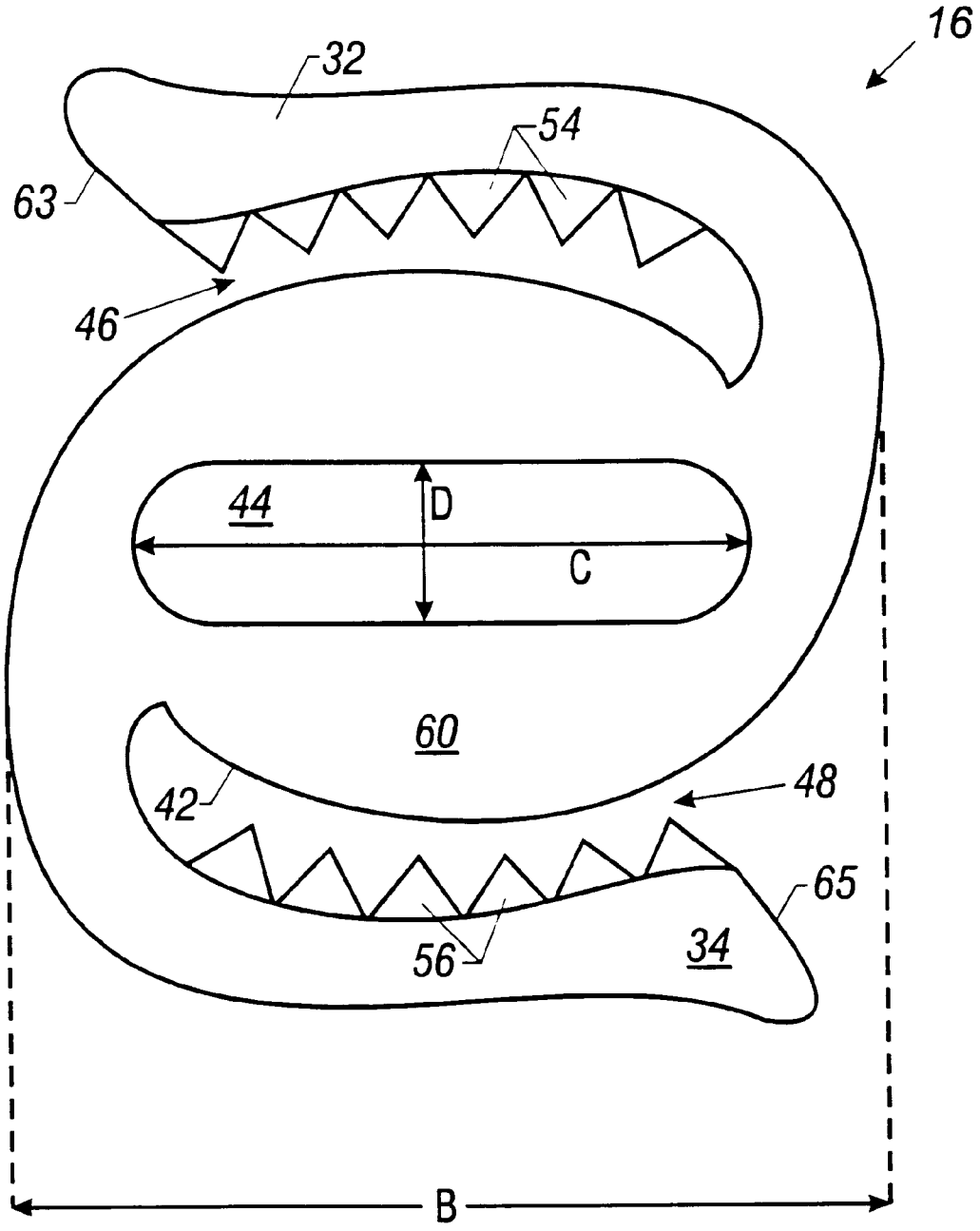
FIG. 3 is a bottom plan view of the cymbal handstrap clip of FIG. 2.

FIGS. 2 and 3 illustrate top and bottom plan views, respectively, of a handstrap clip 16 of the present invention. The handstrap clip 16 includes a body 30, a pair of resilient free arms 32, 34 integrally formed with and extending from the body 30 at respective first and second end regions 36, 38, and an aperture 44 defined through the body 30. The arms 32, 34 extend generally along respective opposite sides 40, 42 of the body 30. Each of the arms 32, 34 cooperate with their respective sides 40, 42 to define slots 46, 48. For example, first arm 32 and first side 40 cooperate to define first slot 46. Likewise, second arm 34 and second side 42 cooperate to define second slot 48. The slots 46, 48 and the central body opening 44 allow adjustable and releasable securement of the handstrap 14 to the musical cymbal 12.

Figure 3A:
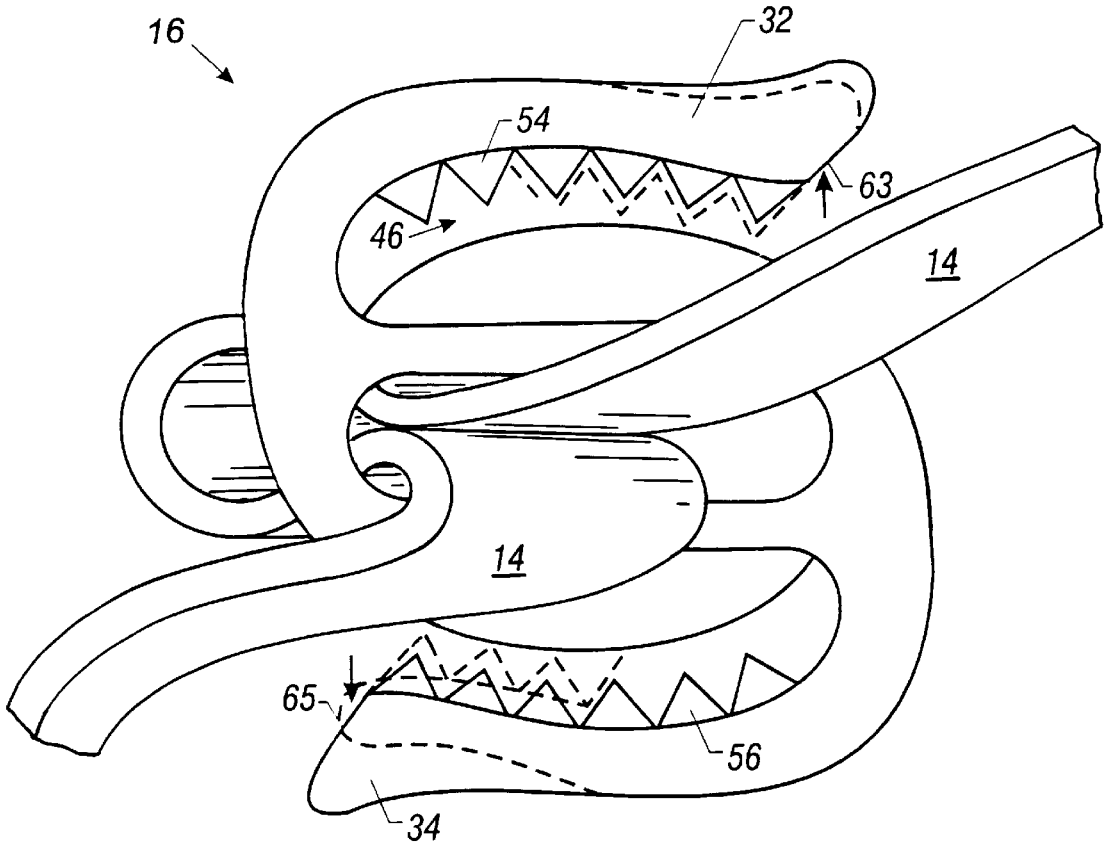
FIG. 3A is a top plan view of the cymbal handstrap clip in an open position.

As shown in FIG. 3A, the handstrap 14 is received in the slots 46, 48 by temporarily expanding the width of the slots 46, 48. Each arm 32, 34, has a respective free end 63, 65 which allows the user to displace the resilient arms 32, 34 from the sides 40, 42 by applying a force (indicated by arrows in FIG. 3A) against each free end 63, 65. With an applied force move the arms 32, 34 to respective "open" positions shown, the slots 46, 48 are open (as shown) and a strap 14 can be positioned and adjusted within the slots 46, 48 according to the preference of an individual. After placing the strap 14 in the slots 46, 48, the force is removed from each free end 63, 65 and the resilient arms 32, 34 return to their original "closed" position (shown in phantom) with the strap 14 secured by engagement with the arms 32, 34 and sides 40, 42. The strap 14 can be removed or adjusted from the slots 46, 48 by again applying a force to the free ends 63, 65 to open the slots 46, 48 and then moving the strap 14.

To assist in securing the strap 14, each of the free arms 32, 34 has a set of gripping elements 54 and 56 positioned between sides 40, 42 of the body 30 and at least an outer region 50 and 52 of each respective free arm 32 and 34. The gripping elements 54, 56 include a plurality of teeth-like projections which extend from the arms 32, 34. These projections snag and engage the material of the strap 14 to prevent slippage of the strap 14 during use of the cymbals 12.

Figure 4:
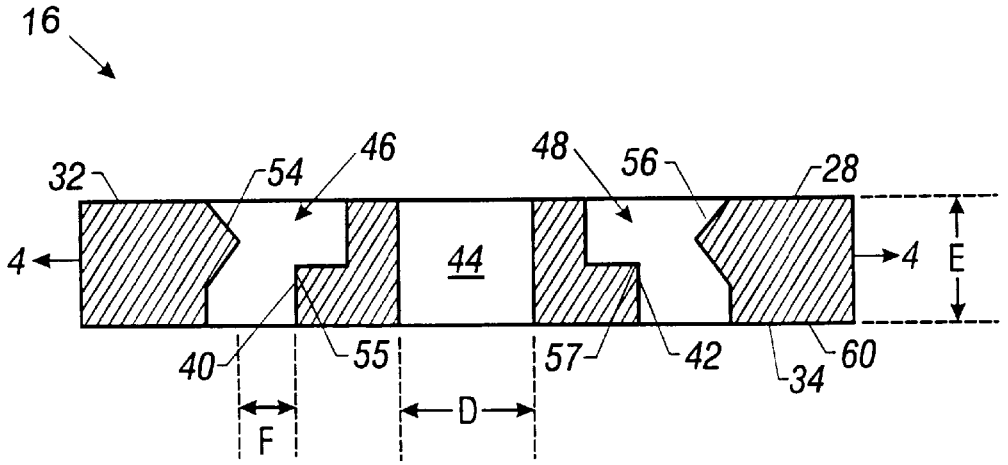
FIG. 4 is a cross sectional view of the cymbal handstrap clip taken at the line 4—4 of FIG. 2.

Referring now to FIG. 4, there is shown a cross sectional view of the clip 16 taken along line 4—4 of FIG. 2. The clip 16 has a thickness of, E, e.g. about 3/16 inch, from top surface 28 to bottom surface 60. In this view, the slots 46, 48 along with aperture 44 are readily seen. Gripping elements 54 of first arm 32 extend into slot 46 where the elements 54 can contact strap 14 when the strap 14 is in position within the slot 46. First side 40 has a lip 55 which contacts the strap 14 and cooperates with the teeth-like groove elements 54 to secure the strap within clip 16. The slot 46 has a width, F, e.g. about 1/16 inch, at the narrowest region between the arm 32 and the side 40 of the body 30 when the arm 32 is in an engaged position. Preferably, this narrow region is the distance between the groove element 54 and the lip 55 of side 40. Similarly, slot 48 is defined by the opening between second arm 34 and second side 42. Gripping elements 56 extend into the slot 48 from the second arm 34. The slot 48 receives the strap 14 to be held in place by teeth 56 of the second arm 34 and by lip 57 of second side 42. Preferably, this is the narrowest region between arm 34 and side 42.

The width, F, in the region of the gripping elements 54, 56 is preferably less than the thickness of that portion of the handstrap 14 engaged in the respective slots 46, 48. This ensures a tight grip on the strap 14 when it is inserted into the slots 46, 48 in a desired position. In this manner, when the arms 32, 34 are opened and then allowed to return to their original position, the gripping elements 54, 56 pinch the strap against the lips 55, 57 of the respective sides 40, 42 to secure the strap 14.

The clip 16 is preferably formed of a plastic material through various methods known in the art, such as molding. The clip is preferably generally flat and smooth on each of the top 28 and bottom 60 surfaces. With reference to FIGS. 2–4, the clip 16 has an overall length, A, e.g. about 1 inch, from the outside edge of arm 32 to the outside edge of arm 34 and a body width of, B, e.g. about 1 1/8 inch, between the opposite edges of body 30. The central aperture 44 is preferably elliptical in shape with a major dimension, C, e.g. about 7/8 inch, along the body 30 and a minor dimension of, D, e.g. about 3/16 inch.

Figure 5:
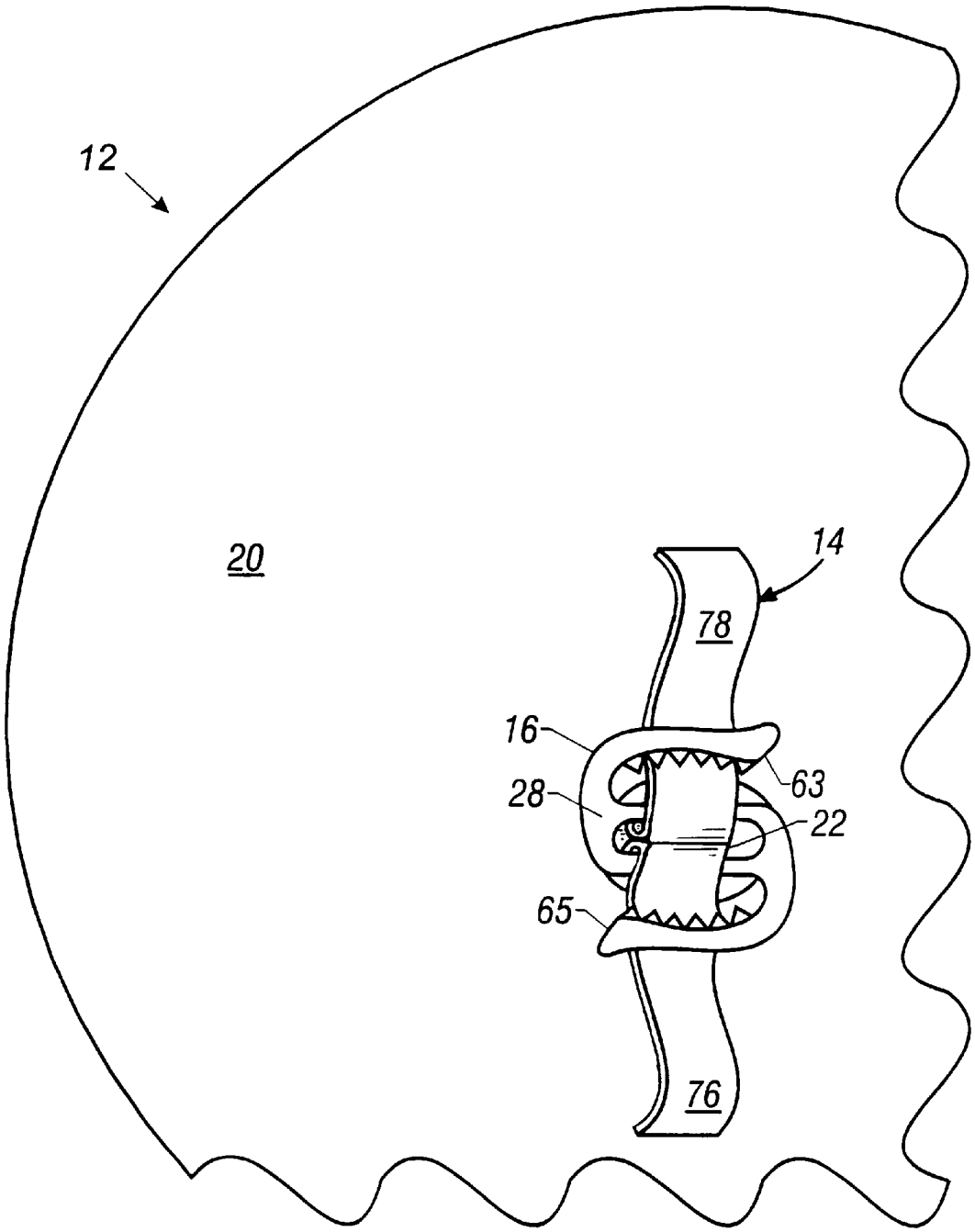
FIG. 5 illustrates a clip securing a handstrap to a cymbal.
Figure 6:
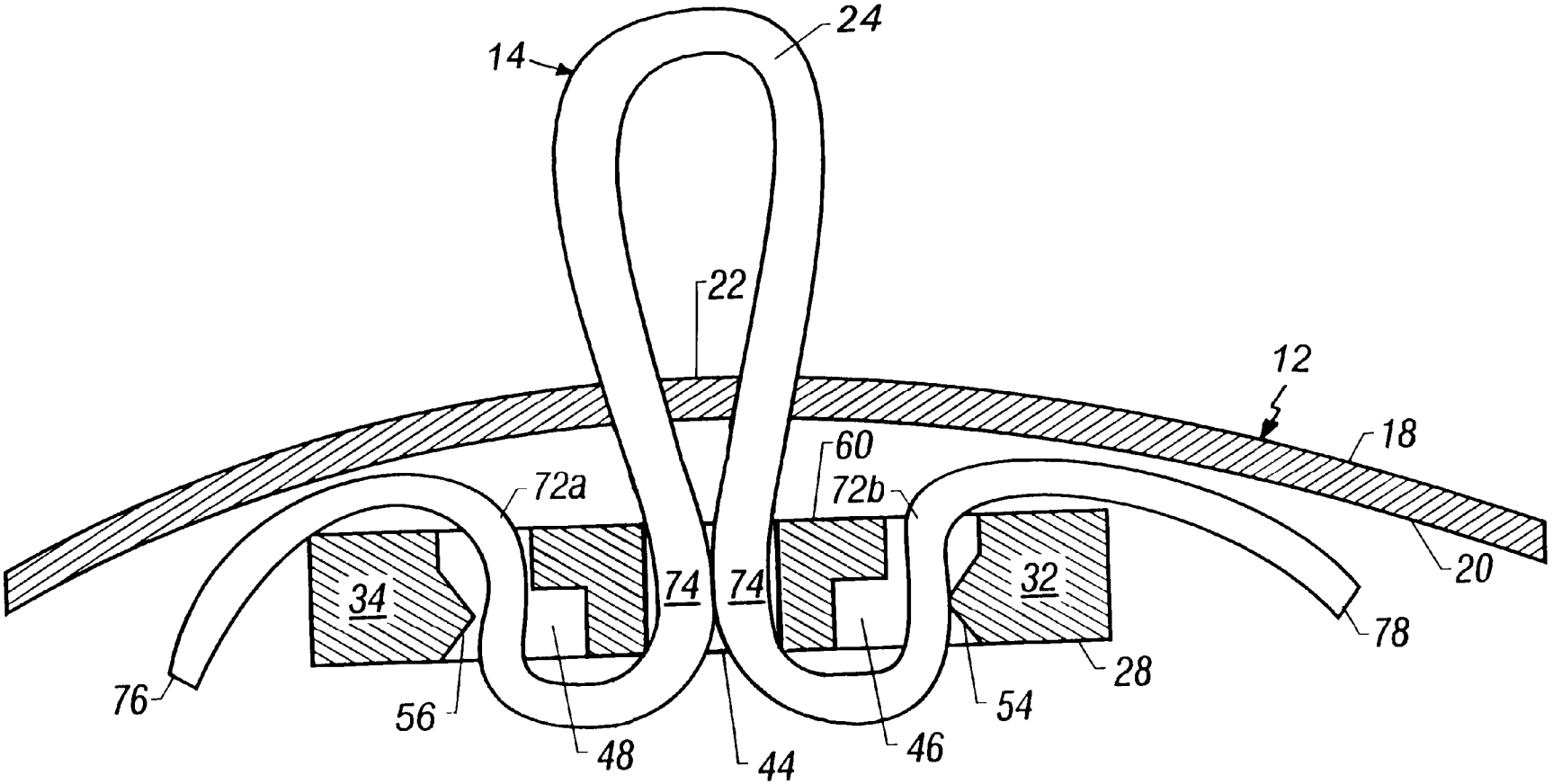
FIG. 6 is a cross sectional view of a handstrap clip securing a handstrap to a cymbal.

FIGS. 5 and 6 illustrate sectional plan and cross-sectional views respectively of the clip 16 in use with a musical cymbal 12 and strap 14. The clip 16 is placed with a bottom surface 60 flush against the concave surface 20 of the cymbal 12 so that the central opening 44 of the body 30 is in axial alignment with the central opening 22 of the cymbal 12. The strap 14 has a hand (loop) portion 24 with a base portion 74 and securement portions 72*a* and 72*b* on respective free ends 76, 78 of the strap 14. The strap 14 is positioned with the central opening 22 of the cymbal 12, with the free ends 76, 78 extending to the concave side of the cymbal and the hand (loop) portion 24 extending to the convex side 18 of the cymbal.

With the body of the strap extending also through the central opening 44 in the body 30 of the clip 16 (also on the concave side of the cymbal, the free ends 76, 78 are inserted into their respective slots by applying force to the ends 63, 65 of the arms 32, 34 to displace the arms 32, 34 to "open" position. Free ends 76, 78 of the strap 14 are then placed within the first and second slots 46 and 48 respectively. First free end 76 of strap 14 is fed upward from the surface 28 of the clip 16 so that the end 76 passes through the slot 48 and across the surface 60 of the arm 34. In like manner, free end 78 of the strap 14 is inserted into groove 46 from surface 28 of the clip 16 and then passed over surface 60 of arm 32. A base portion 74 of the strap 14 is left within the central opening 44 on the body 30 of the clip 16 and securement portions 72*a*, 72*b* of the strap 14 are left within respective slots 48, 46. The ends 76, 78 of the strap 14 extend away from clip 16 where they can be pulled and stretched to tighten the strap and the loop-like hand portion 24 according to an individual user's hand or wrist size, or preference, without the use of knots. The force applied to free ends 63, 65 is released to allow the arms 32, 34 to return to closed position, with the securement portions 72*a*, 72*b* engaged by gripping elements 56, 54 and sides 42, 40 to secure the strap 14. The strap 14 can be adjusted or removed, e.g. by the user, by moving the arms 32, 34 to the open position again. The clip 16, with arms 32, 34 and gripping elements 54, 56, therefore provides an adjustable and releasable device for securing the strap 14 to the musical cymbal 12.

Other embodiments are within the following claims.

What is claimed is:

1. A musical cymbal and handstrap assembly comprising:

a musical cymbal having a first side and a second side, and defining a central aperture, a cymbal handstrap clip, a handstrap comprising a hand portion extending through said aperture onto said first side of said cymbal and a securement portion on said second side of said cymbal, said securement portion of said handstrap releasably and adjustably secured to said cymbal handstrap clip, said cymbal handstrap clip comprising:

a body, a first free arm extending from a first end of said body and generally along a first side of said body, and a second free arm extending from a second end of said body, opposite said first end, and generally along a second side of said body, opposite said first side of said body, said body defining an aperture containing a base portion of said hand portion of said handstrap, said first free arm and said first side of said body together defining a first slot, and said second free arm and said second side of said body together defining a second slot, said securement portion of said handstrap extending through said first slot and through said second slot.

2. The musical cymbal and handstrap assembly of claim 1, wherein said first side of said musical cymbal defines a convex surface.

3. The musical cymbal and handstrap assembly of claim 1, wherein said second side of said musical cymbal defines a concave surface.

4. The musical cymbal and handstrap assembly of claim 1 wherein said hand portion of said handstrap defines a closed loop.

5. The musical cymbal and handstrap assembly of claim 1 wherein said securement portion of said handstrap comprises a first free end and a second free end.

6. The musical cymbal and handstrap assembly of claim 5 wherein said first free end and said second free end of said handstrap extend at opposite sides of said hand portion.

7. The musical cymbal and handstrap assembly of claim 1 wherein said first and said second free arms each have an outer region and said cymbal handstrap clip includes a first set of gripping elements between said first side of said body and at least said outer region of said first free arm in said first slot, and a second set of gripping elements between said second side of said body and at least said outer region of said second free arm in said second slot.

8. The musical cymbal and handstrap assembly of claim 7 wherein said first slot has a width in the region of said gripping elements that is less than the thickness of said securement portion of said handstrap engaged in said first slot, and said second slot has a width in the region of said gripping elements that is less than the thickness of said securement portion of said handstrap engaged in said second slot.

9. The musical cymbal and handstrap assembly of claim 1 wherein said first free arm and said second free arm of said cymbal handstrap clip extend resiliently from said body.

10. A method for securing a handstrap to a cymbal comprising the steps of:

providing a cymbal having a first convex side and a second concave side and defining a central aperture;

providing a cymbal handstrap clip having:

a body, a first free arm extending from a first end of said body and generally along a first side of said body, and a second free arm extending from a second end of said body, opposite said first end, and generally along a second side of said body, opposite said first side of said body, said body defining a body aperture, said first free arm and said first side of said body together defining a first slot, and said second free arm and said second side of said body together defining a second slot;

providing a handstrap comprising a securement portion and a hand portion having a base portion;

positioning said handstrap through said central aperture of said cymbal with said hand portion extending to said first convex side of said cymbal, said base portion of said hand portion through said body aperture of said cymbal handstrap clip at said second concave side of said cymbal; and engaging said securement portion of said handstrap through said first slot and through said second slot of said cymbal handstrap clip to secure said handstrap to said cymbal handstrap clip.

11. The method of claim 10 wherein said securing step includes releasably and adjustably securing said handstrap to said cymbal handstrap clip.

12. A handstrap assembly for use with a musical cymbal Saving a first side, a second side, and a central aperture, the handstrap assembly comprising:

a cymbal handstrap clip, a handstrap comprising a hand portion extending through said aperture onto said first side of said cymbal and a securement portion on said second side of said cymbal, said securement portion of said handstrap releasably and adjustably secured to said cymbal handstrap clip, said cymbal handstrap clip comprising:

body, a first free arm extending from a first end of said body and generally along a first side of said body, and a second free arm extending from a second end of said body, opposite said first end, and generally along a second side of said body, opposite said first side of said body, said body defining an aperture containing a base portion of said hand portion of said handstrap, said first free arm and said first side of said body together defining a first slot, and said second free arm and said second side of said body together defining a second slot, said securement portion of said handstrap extending through said first slot and through said second slot.

13. The handstrap assembly of claim 12 wherein said hand portion of said handstrap defines a closed loop.

14. The handstrap assembly of claim 12 wherein said securement portion of said handstrap comprises a first free end and a second free end.

15. The handstrap assembly of claim 12 wherein said first free end and said second free end of said handstrap extend at opposite sides of said hand portion.

16. The handstrap assembly of claim 12 wherein said first and said second free arms each have an outer region and said cymbal handstrap clip includes a first set of gripping elements between said first side of said body and at least said outer region of said first free arm in said first slot, and a second set of gripping elements between said second side of said body and at least said outer region of said second free arm in said second slot.

17. The handstrap assembly of claim 12 wherein said first slot has a width in the region of said gripping elements that is less than the thickness of said securement portion of said handstrap engaged in said first slot, and said second slot has a width in the region of said gripping elements that is less than the thickness of said securement portion of said handstrap engaged in said second slot.

18. The handstrap assembly of claim 12 wherein said first free arm and said second free arm of said cymbal handstrap clip extend resiliently from said body.

19. A musical cymbal handstrap clip for releasably and adjstably attaching a handstrap to a musical cymbal having a central aperture, said handstrap clip comprising:

a body, a first free arm extending from a first end of said body and generally along a first side of said body, and a second free arm extending from a second end of said body and generally along a second side of said body, said body defining an aperture for receiving a portion of said handstrap, said first free arm and said first side of said body together defining a first slot for receiving said handstrap, and said second free arm and said second side of said body together defining a second slot for receiving said handstrap.

20. The cymbal handstrap clip of claim 19 wherein said first and said second free arms each have an outer region and said cymbal handstrap clip further includes a first set of gripping elements between said first side of said body and at least said outer region of said first free arm in said first slot, and a second set of gripping elements between said second side of said body and at least said outer region of said second free arm in said second slot.

21. The cymbal handstrap clip of claim 20 wherein said first slot has a width in the region of said first set of gripping elements that is less than the thickness of said handstrap to be received in said first slot, and said second slot has a width in the region of said second set of gripping elements that is less than the thickness of said handstrap to be received in said second slot.

22. The cymbal handstrap clip of claim 19 wherein said first free arm and said second free arm extend resiliently from said body.

23. The cymbal handstrap clip of claim 19 wherein said second end of said body is opposite said first end and said second side of said body is opposite said first side of said body.

24. A method for adjusting a handstrap to a cymbal comprising the steps of:

providing a cymbal having a first convex side and a second concave side and defining a central aperture;

providing a cymbal handstrap clip having:

a body, a first free arm extending from a first end of said body and generally along a first side of said body, and a second free arm extending from a second end of said body, opposite said first end, and generally along a second side of said body, opposite said first side of said body, said body defining a body aperture, said first free arm and said first side of said body together defining a first slot, and said second free arm and said second side of said body together defining a second slot;

providing a handstrap comprising first and second free ends;

positioning said handstrap with said first and second free ends of said handstrap extending through said central aperture to said second concave side of said cymbal and through said body aperture of said clip at said concave side of said cymbal, thereby to form a hand portion of said handstrap on said first side of said cymbal;

extending said first free end of said handstrap through said first slot of said clip and said second free end of said handstrap through said second slot of said clip to form a securement portion of said handstrap;

adjusting said first and second free ends to adjust said hand portion of said handstrap.

* * * * *

UNITED STATES PATENT AND TRADEMARK OFFICE

CERTIFICATE OF CORRECTION

PATENT NO. : 5,990,402

DATED : NOVEMBER 23, 1999

INVENTOR(S) : FRANK B. EPSTEIN

It is certified that error appears in the above-identified patent and that said Letters Patent is hereby corrected as shown below:

Column 6, Line 7, Delete "saving" and insert --having--.

Signed and Sealed this

Tenth Day of April, 2001

*Attest:*

Nicholas P. Godici

NICHOLAS P. GODICI

*Attesting Officer*

*Acting Director of the United States Patent and Trademark Office*